US005697763A

United States Patent [19]

Kitchener

[11] Patent Number: 5,697,763

[45] Date of Patent: Dec. 16, 1997

[54] TANK MOUNTED ROTARY COMPRESSOR

[75] Inventor: Anthony J. Kitchener, Richmond, Australia

[73] Assignee: Cash Engineering Research Pty Ltd, Richmond, Australia

[21] Appl. No.: 633,751

[22] PCT Filed: Oct. 28, 1994

[86] PCT No.: PCT/AU94/00664

§ 371 Date: Apr. 24, 1996

§ 102(e) Date: Apr. 24, 1996

[87] PCT Pub. No.: WO95/12071

PCT Pub. Date: May 4, 1995

[30] Foreign Application Priority Data

| | | | |
|---|---|---|---|
| Oct. 29, 1993 | [AU] | Australia | PM 2134 |
| Dec. 14, 1993 | [AU] | Australia | PM 2991 |
| Jan. 28, 1994 | [AU] | Australia | PM 3582 |

[51] Int. Cl.[6] ..... F04C 29/00; F04C 29/02

[52] U.S. Cl. ..... 417/28; 418/84; 417/53

[58] Field of Search ..... 418/84; 417/28, 417/90, 53

[56] References Cited

U.S. PATENT DOCUMENTS

| | | | |
|---|---|---|---|
| 3,506,376 | 4/1970 | Dangauthier | 417/28 X |
| 3,813,850 | 6/1974 | Uratani . | |
| 4,171,188 | 10/1979 | Anderson et al. . | |
| 4,180,986 | 1/1980 | Shaw | 418/84 X |
| 4,475,876 | 10/1984 | Olen | 418/84 |

FOREIGN PATENT DOCUMENTS

| | | |
|---|---|---|
| 14596/70 | 11/1971 | Australia . |
| 2636493 | 2/1978 | Germany . |
| 2846005 | 4/1980 | Germany . |
| 922004 | 5/1965 | United Kingdom . |
| 1257728 | 12/1971 | United Kingdom . |

OTHER PUBLICATIONS

Patent Abstracts of Japan, M1560, p. 80, JP,A, 5–296172 (Hitachi Ltd.) 9 Nov. 1993.

patent Abstracts of Japan, M1389, p. 137, JP,A, 4–325796 (Hitachi Ltd.) 16 Nov. 1992.

*Primary Examiner*—Richard E. Gluck

*Attorney, Agent, or Firm*—The Bell Seltzer Intellectual Property Group of Alston & Bird LLP

[57] ABSTRACT

A rotary compressor having a drive motor and a single pressure vessel, wherein the pressure vessel acts both as a gas oil separator and as a compressed gas storage tank. The compressor employs a control for valves in order to close off the supply of oil and gas from entering the compressor prior to cessation of the compressor's rotation.

7 Claims, 6 Drawing Sheets

TANK MOUNTED ROTARY COMPRESSOR

The present invention relates to improvements in rotary compressor systems. Rotary compressor systems include screw compressors utilising intermeshing rotors, vane and scroll type compressors.

Conveniently, rotary compressor systems comprise a compressor unit, a drive motor drivingly coupled to the compressor unit to drive same, a separator vessel defining a volume containing a supply of lubricating liquid (hereinafter called "oil") and arranged to receive a mixture of compressed gas and liquid from the compressor unit, a filter element through which compressed gas flows to a clean compressed gas storage tank, an oil filter and oil cooling device through which oil passes in a return line from the separator vessel to an inlet region of the compressor unit, and appropriate piping and valving linking the system together. Various improvements have been proposed to such systems to improve performance, limit componentry to decrease manufacturing costs and to decrease package sizes, however, such systems still remain relatively complex with package sizes larger than equivalent reciprocating compressor systems, particularly in smaller capacity machines.

Such systems have also always had competing design interests. For example, to reduce package sizes, it is desirable to, reduce the physical size of the larger volume components such as the separator vessel and the gas storage tank. However, to improve capability of the machine to work longer between service periods to replace the oil, it is desirable for the separator vessel to be as large as possible so that the volume of oil used in the system can also be as large as possible. Moreover, with systems using minimum pressure valves (mpv) to maintain a minimum pressure in the separator so as to allow oil circulation back to the compressor unit by pressure differential, it is generally desirable to keep the separator volume below a certain level so as to prevent too much of a delay at start up before the minimum pressure is achieved so that lubricating oil can be returned to the compressor unit. The problem is exacerbated by the oil desirably entering the compressor unit at a pressure greater than atmospheric pressure (say 2.5 atmospheres) so as not to obstruct suction volumes of air through the compressor unit. Thus, the minimum pressure level needs to be above this level (say 3.5 atmospheres) to create the necessary pressure differential. Thus, if the separator volume is too large the screw rotors may seize before lubricating oil starts to flow. Opposed to this, it is also desirable to have a separator vessel volume as large as possible so that it can cope with oil foaming (which occurs during certain stages of system operation) without having the foaming oil flowing into bulk contact with the final filter element. The tendency has, however, been to design compressor systems with ever decreasing sized separator vessel volumes sometimes with attempts to solve the aforementioned oil volume and foaming problems by other techniques. It still remains, however, a desirable attribute that the separator vessel be as large as possible to allow use of increased oil volumes.

There is a still further problem with many rotary compressor systems in that they commonly employ a pressure lowering valve to lower the pressure in the separator vessel down to the minimum pressure level so as to reduce the compression ratio of the compressor during unloaded operation or when it is stopped. Some systems also operate under loaded and unloaded conditions cyclically and if, each time, it is operated unloaded, the pressure lowering valve dumps pressure from the separator vessel, then this amounts to a significant efficiency loss from the system. The operational mode of some systems is on a stop/start cycle basis and again when the system is stopped, pressure is each time dumped from the separator vessel resulting in a significant lack of efficiency. This of course also emphasises the problems discussed above with systems using pressure lowering valves.

The objective of the present invention is to provide a rotary compressor system, particularly for use in machinery of smaller capacity, which will reduce the complexity and size of the system package without sacrificing system performance characteristics.

Accordingly, the present invention provides a rotary compressor system characterized by a pressure vessel acting as both a separator vessel and a compressed gas storage tank whereby compressed gas is supplied to an end user directly from said pressure vessel. Preferably said pressure vessel is relatively increased in size so that the pressure vessel also acts as an oil cooler. Conveniently, cooling fan means may be provided to pass cooling or ventilating air over said pressure vessel to increase cooling capacity.

It will of course be appreciated that by using only one pressure vessel for both the separator and the storage tank functions, the overall package volume is significantly decreased. Moreover, while still decreasing the overall package volume, it is possible to use a "single" pressure vessel of substantially larger volume so that relatively increased volumes of oil can be used in the system. This also decreases the need for oil cooling capacity so that the oil can be adequately cooled while in the pressure vessel without the need of using a separate oil cooler. Again, the ability of omitting a separate oil cooler allows the overall package volume to be decreased and simplifies the assembly of the system.

In accordance with a further aspect of this invention, there is provided a compressor system comprising a rotary compressor unit arranged to deliver a mixture of compressed gas and oil entrained therein into a pressure vessel, a drive motor coupled to said compressor unit to drive said unit, a filter element through which compressed gas passes from said pressure vessel to an end user without passing through a separate gas storage tank, oil return means for returning oil from said pressure vessel to the compressor unit, and means for preventing moisture build up in said pressure vessel.

A problem exists when a single pressure vessel is used in replacement of prior art arrangements employing both a separator vessel and a gas storage tank. This problem is the possible condensation of moisture in the oil as oil cools in the pressure vessel rather than in a separate oil cooler as in prior art systems. This situation is of course exacerbated in systems which are operated infrequently whereby the oil is allowed to cool to a significant extent. Condensation build up in the pressure vessel will turn the oil into a form of mayonnaise which will make the system unworkable.

To solve this problem the present invention provides means for preventing moisture build up in the pressure vessel. This may be achieved in a first preferred embodiment by moisture removing means to remove moisture from gas flowing to the inlet zone of said compressor unit. In a second preferred embodiment, the means for preventing moisture build up in the pressure vessel may comprise means for removing moisture from the oil in the pressure vessel itself.

The difficulty with moisture in air being compressed is that the moisture condenses at high pressures and mixes with oil to form a consistency like mayonnaise. Furthermore, in small capacity compressor systems, compressed air consumption is usually variable so that heat rejection rates are difficult to control and prevention of moisture condensation is therefore also difficult to achieve. This is particularly difficult where the pressure vessel also acts as a cooler since the walls of the vessel are always cold. Moreover, in many industries, dry compressed air is required by the end user and in consequence it is becoming increasingly more common for dryers to be provided down stream of the compressor system so that the compressed gas can be dried. Thus, in one preferred aspect, the present invention aims at providing a moisture removing means (dryer or the like) on the suction side of the compressor unit thereby removing moisture before compression. While the use of dryers do involve the use of some energy thereby lowering efficiencies somewhat, they are clearly not a penalty in any industry already using dryers on the discharge side of the compressor unit. Moreover the energy savings, by not having to blow down the separator vessel, are believed likely to outweigh any inefficiency involved in the use of a dryer on the suction side of the compressor unit.

In an alternative arrangement, in some systems, it may be possible for the means for preventing moisture build up to be means to control the temperature of the pressure vessel during system operation so that it will run at a relatively hot temperature and that the temperature will be built up rapidly at start up so that any condensed moisture is driven off in the compressed gas discharge.

Operating characteristics of the system are as follows. When the compressor unit stops (control systems for all small capacity machines is stop/start), a non return valve at the compressor inlet closes so that air and oil cannot escape from the system. As a result, air and oil cannot escape from the system so that less power is consumed during operation.

A still further problem exists when a single pressure vessel is used in replacement of prior art arrangements employing both a separator vessel and a gas storage tank. This problem is that the compressor unit must start against full pressure in the pressure vessel which is not the case with conventional systems using a separator vessel and a gas storage tank. With such conventional systems, the separator vessel is blown down to atmosphere before restarting the system but this cannot be done when a single large pressure vessel is used because too much compressed gas would be lost. Screw compressor units have a fixed compression ratio so that the output pressure is a fixed multiple of the inlet pressure. For example, if the compression ratio is eight and if the compressor unit is restarted with say 6 bar inlet pressure (communicated from the pressure vessel), then the discharge pressure is 48 bars. It is possible with direct drive between the motor and the compressor unit as is conventional in the prior art, that the aforementioned problem will cause the motor to stall thereby preventing restarting of the system. If stalling does not in fact occur, then at the very least, costly measures of handling the momentary high pressures would be required. The present invention, in a preferred aspect also aims at providing a system which will solve the aforementioned difficulty.

In accordance with this aspect, the present invention aims to provide a compressor system which is capable of solving the aforementioned problem while using a single pressure vessel. Accordingly, the present invention also provides a rotary compressor system comprising a compressor unit arranged to deliver a mixture of compressed gas and oil entrained therein into a pressure vessel, a drive motor coupled to said screw compressor unit to drive said unit, and regulator means enabling said motor to be started from a stopped condition with pressure of said pressure vessel in an inlet region of said compressor unit. Conveniently, in the preferred embodiment, the regulator means comprises a slip clutch coupling the motor to said compressor unit.

In a second preferred embodiment, the regulator means may comprise means to control power supplied to the motor whereby the motor slowly builds up to speed when restarted. In this case the motor may be directly coupled to the compressor unit. The embodiment using a clutch means coupling is designed so as to allow slip in the drive coupling so that gradual loading of the compressor unit occurs as it speeds up. The clutch device may be a centrifugal type clutch but any other similar device could also be used. Internal leakage in the compressor unit prevents build up of excessive pressure as the inlet is evacuated at low speed. The clutch device also limits maximum input torque thereby protecting the compressor unit. The clutch device, at least in direct coupled machines (i.e. no belt or gear transmission), replaces the coupling. Further, the peak start up amps drawn by the motor is reduced.

In accordance with a still further aspect of the present invention, a system of the aforementioned type is proposed utilising a single pressure vessel without any requirement of limiting the size of the pressure vessel so that a pressure differential can be quickly established to create oil return flow to the compressor unit. According to this aspect, the present invention proposes a rotary compressor system comprising a compressor unit arranged to deliver a mixture of compressed gas and oil entrained therein into a pressure vessel, a drive motor coupled to said compressor unit to drive said unit, a minimum pressure valve arranged to maintain a minimum pressure in said pressure vessel during normal system operation, oil return means for returning oil from said pressure vessel to a zone of the screw compressor unit having a first predetermined pressure during normal compressor system operation, valve means through which gas to be compressed flows to said compressor unit, said valve means being configured to establish a second predetermined pressure at said zone after start up of the compressor unit while still permitting gas flow into the compressor unit, said second predetermined pressure being less than said first predetermined pressure. Conveniently, a partial vacuum pressure is established at the inlet to the compressor unit whereby a pressure of up to (but preferably slightly less than) one atmosphere is established at said zone where oil is reintroduced into the compressor unit whereby, after start up, any increased pressure in the pressure vessel causes a pressure differential to create liquid flow from the pressure vessel to said zone. Thus, it is not necessary to build the pressure in the vessel to a level above the minimum set by the minimum pressure valve before liquid flow to the compressor unit begins. Conveniently, once the minimum pressure level set by the minimum pressure valve is achieved in the pressure vessel, the valve means is adapted to open completely whereby the pressure at said zone is the first predetermined pressure.

In the aforementioned embodiments, the pressure within the pressure vessel is retained in the compressor unit and acts on the seals and valves associated with the compressor unit. While this is not an insurmountable problem, it would be preferable that this did not occur.

A preferred objective therefore of the present invention is to also provide an arrangement in compressor systems of the aforementioned kind and a method of operating such systems which will avoid the prospect of pressure being dumped cyclically from the system while at the same time avoiding high pressure conditions within the compressor unit and making starting of the compressor unit easier.

According to this aspect, the present invention provides a compressor system comprising a rotary compressor unit with rotary compression means, a motor driving said compressor unit, a pressure vessel receiving pressurised gas and oil discharged from a discharge end of said compressor unit with oil being returned from said vessel to an inlet region of said compressor unit, said system being characterized by first valve means controlling gas flow into the compressor unit, second valve means controlling flow of oil to the inlet region of the compressor unit from said pressure vessel, third valve means controlling gas/oil discharge from said compressor unit to flow to said vessel, and control means arranged to control operation of first and second valve means and said motor whereby, in use, said first and second valve means are closed prior to cessation of rotation of said rotary compression means. The rotary compression means should complete at least one and preferably several revolutions after the first and second valve means are closed so as to cause a vacuum in the inlet region of the compressor unit and so as most of the oil in the rotor region is discharged therefrom. Conveniently, the discharge volume (i.e. the gas containing volume of the compressor unit upstream of the non-return valve means and downstream of the discharge point of intermeshing rotors) is selected relative to the intake volume of the compressor unit (i.e. the gas containing volume downstream of the first valve means) so as to ensure an equilibrium pressure within the compressor unit when the valve means are closed, that is, sufficiently low as to not inhibit restarting of the compressor unit. Conveniently the equilibrium pressure is about one atmosphere but may be up to 2.5 to 3.0 atmospheres.

In accordance with the present invention, the rotary compressor unit may be a screw compressor with intermeshing rotors forming the rotary compression means or may be any other rotary compressor including vane and scroll compressors.

Ensuring rotation of the rotary compression means after closure of the valve means might be achieved by any one of a number of possible means. One means may be by simply selecting the inherent inertia of the rotary compression means and the rotating components of the motor such that when operation of the motor is discontinued, the inertia ensures sufficient numbers of revolutions prior to stopping to achieve the desired vacuum conditions in the inlet region and the displacement of liquid from the region of the rotary compression means. If the inherent inertia of the rotary compression means and rotating components of the motor is insufficient, then the system may include additional inertia such as a flywheel or the like to ensure rotation of the rotary compression means for a sufficient period following closure of the valve means. In another possible configuration, the control means may be arranged so as to close the valve means first and allow the motor to operate for a small but definite period after closure of the valve means.

At start up of a system of the aforementioned kind, where it is intended to use differential pressure between the pressure vessel and the compressor unit for recirculating liquid to the compressor unit, it is necessary to build up pressure slowly to the minimum pressure level. To achieve this, the first valve means is retained initially closed and a small capacity gas line with a flow restrictor and valve means (preferably a non-return valve) directs gas flow downstream of the first valve means so that gas is slowly drawn into the inlet region of the compressor unit. Once the minimum pressure is achieved, the first valve means is opened and normal operation follows. Moreover, if the equilibrium pressure is in fact a vacuum pressure in the compressor unit when the motor is stopped, then the gas bleed line may effectively deliver gas into this compressor unit to form an equilibrium pressure of one atmosphere.

According to a further aspect of the present invention, there is provided a method of operating a compressor system of the type comprising a compressor unit with rotary compression means, a motor driving said rotary compression means, a pressure vessel receiving pressurised gas and oil from a discharge end of said compressor unit with oil being returned from said vessel to an inlet region of said compressor unit, said method being characterized by closing first valve means controlling gas flow into the compressor unit and second valve means controlling oil flow back to the compressor unit, by a predetermined time prior to cessation of rotation of said rotary compression means so as to create vacuum conditions in the inlet region of said compressor unit and to displace oil from said rotors upon stopping of the motor.

By the arrangements and method discussed above, when it is desired during normal operation or general shut down of the system, to stop operation of the compressor unit, the system permits normal pressures (i.e. one atmosphere or a pressure not greatly exceeding one atmosphere) to be maintained within the compressor unit thereby ensuring ease of restarting while at the same time pressure levels in the pressure vessel are maintained so that no losses occur that would affect efficiency levels.

Several preferred embodiments will hereinafter be described with reference to the accompanying drawings, in which:

FIG. 1 is a schematic view of a first preferred embodiment;

FIGS. 2*a* and 2*b* are schematic views of two further preferred embodiments;

Figure 1:
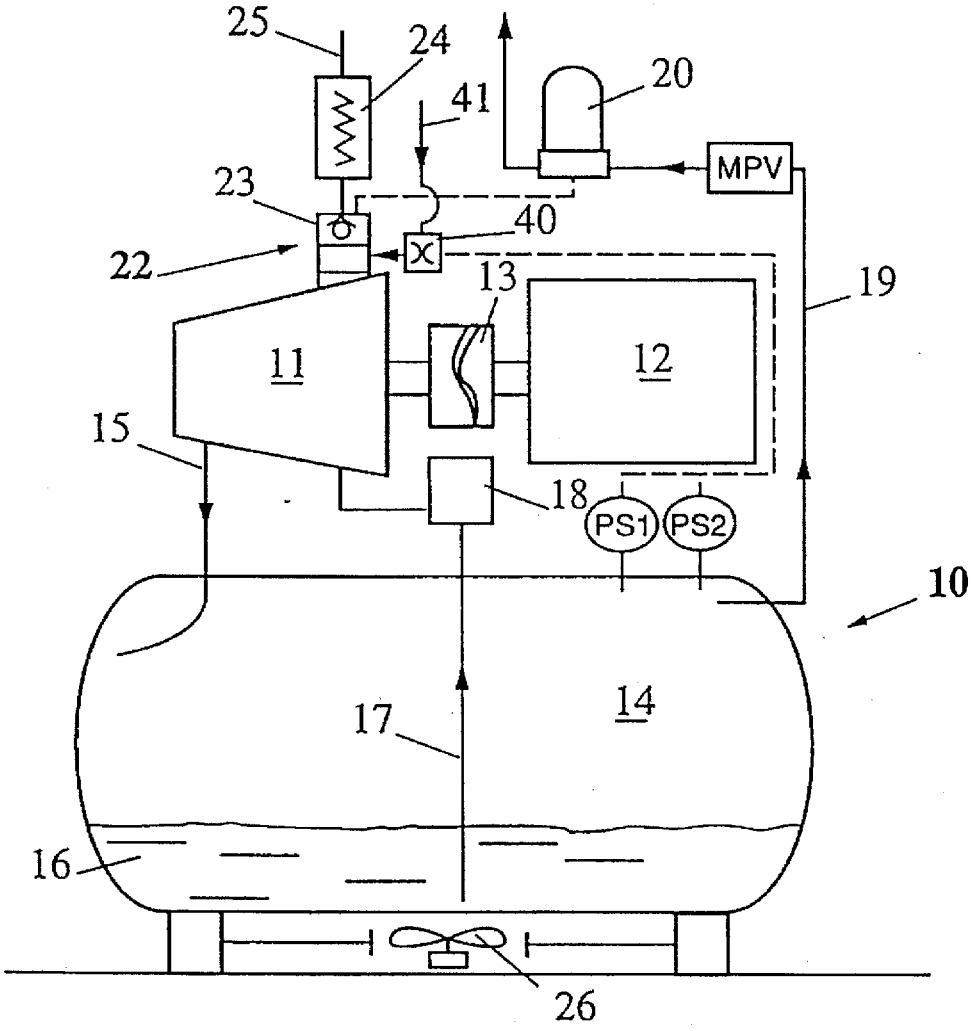

With reference to FIG. 1, a compressor system 10 is schematically illustrated comprising a screw compressor unit 11 driven by a motor 12 through a direct transmission which may include a centrifugal clutch device 13. The compressor unit 11 and motor 12 are conveniently mounted on a pressure vessel 14 so that compressed gas and entrained liquid is discharged via line 15 directly into the vessel 14. A pool 16 of oil is maintained in the bottom of the vessel 14 and is returned therefrom by line 17 via an oil filter 18 to an inlet region of the compressor unit 11. Compressed gas with some oil droplets retained are discharged from the system direct to an end user via line 19 and a final filter 20. The filter element 20 may be mounted to the tank 14 with an arrangement for returning oil collected in the filter element into the inlet region of the compressor unit 11. Alternatively, the filter element 20 might be mounted separately from the tank 14. Conveniently, the valving includes a non-return valve 23 which will allow air flow into the compressor unit during operation but prevents compressed air and oil flow in the reverse direction if the oil compressor unit 11 stops. The valving 22 also may include a solenoid valve 40 controlling gas inflow through line 41 into the inlet zone of the compression unit 11. The solenoid valve 40 is actuated in response to signals from pressure sensing means PS1 and PS2 adapted to sense pressure within the pressure vessel 14 as explained hereinafter. Finally, a dryer 24 may be provided in the air flow passage 25 into the compressor unit 11.

In normal operation, the suction air passes via line 25 to the compressor inlet region, passing through the non-return valve 23. Oil is injected and the air is compressed. The mixture of compressed air and oil is piped via line 15 to the pressure vessel 14 where most of the oil settles by gravity to the pool 16 in the bottom of the vessel 14. The compressed gas (with small amounts of entrained oil droplets) leaves the vessel 12 via line 19 and is further cleaned by the fine oil filter 20 before being discharged directly to an end user. The oil volume in the system can be quite large and has therefore a high thermal inertia. It will constantly cool by conduction with the walls of the vessel 14. If desired, the vessel underside may be fitted with a fan 26 to increase air flow levels over the belly of the vessel 14. At start up of the compressor unit with the inlet valve closed, if the pressure in the vessel 14 is greater than a first predetermined (PS1) level defined by a minimum pressure valve (mpv) (for example 3.5 atmospheres) but less than an upper level (PS2) (say 7 atmospheres) then the motor starts and the compressor inlet opens. This is essentially normal operation. If the pressure is greater than the upper level (PS2), then the compressor will not start if the pressure is less than (PS1) the inlet valve is closed but the solenoid valve 40 opens. Flow through this valve is restricted so that suction pressure is reduced to a partial vacuum in the compressor inlet so that pressure differential allows oil flow along line 17 to the compressor unit 11. When pressure in the vessel 14 gets above (PS1) then the solenoid valve 40 closes and the inlet opens so that normal air flow to the compressor unit is established. The solenoid valve 40 is a normally closed valve and thereby line 41 is closed until valve 40 is opened as aforesaid.

Figure 2A:
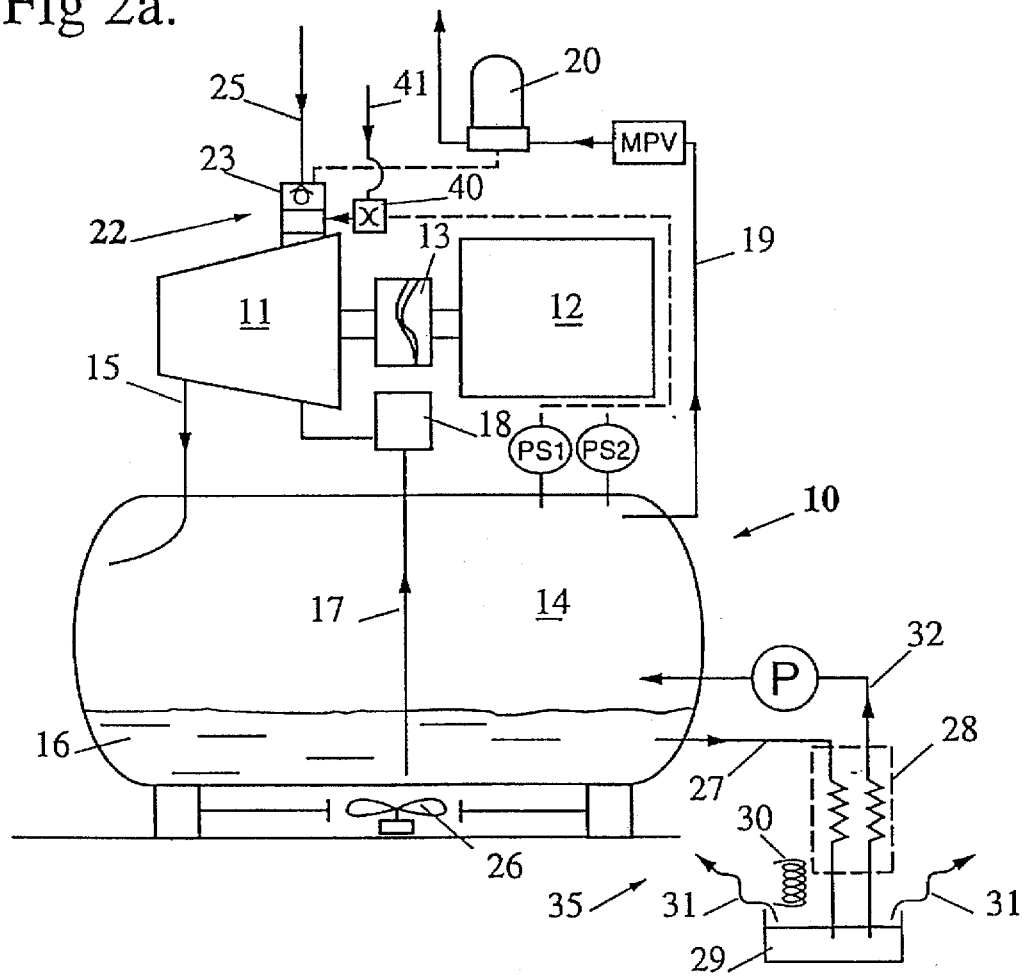
Figure 2B:
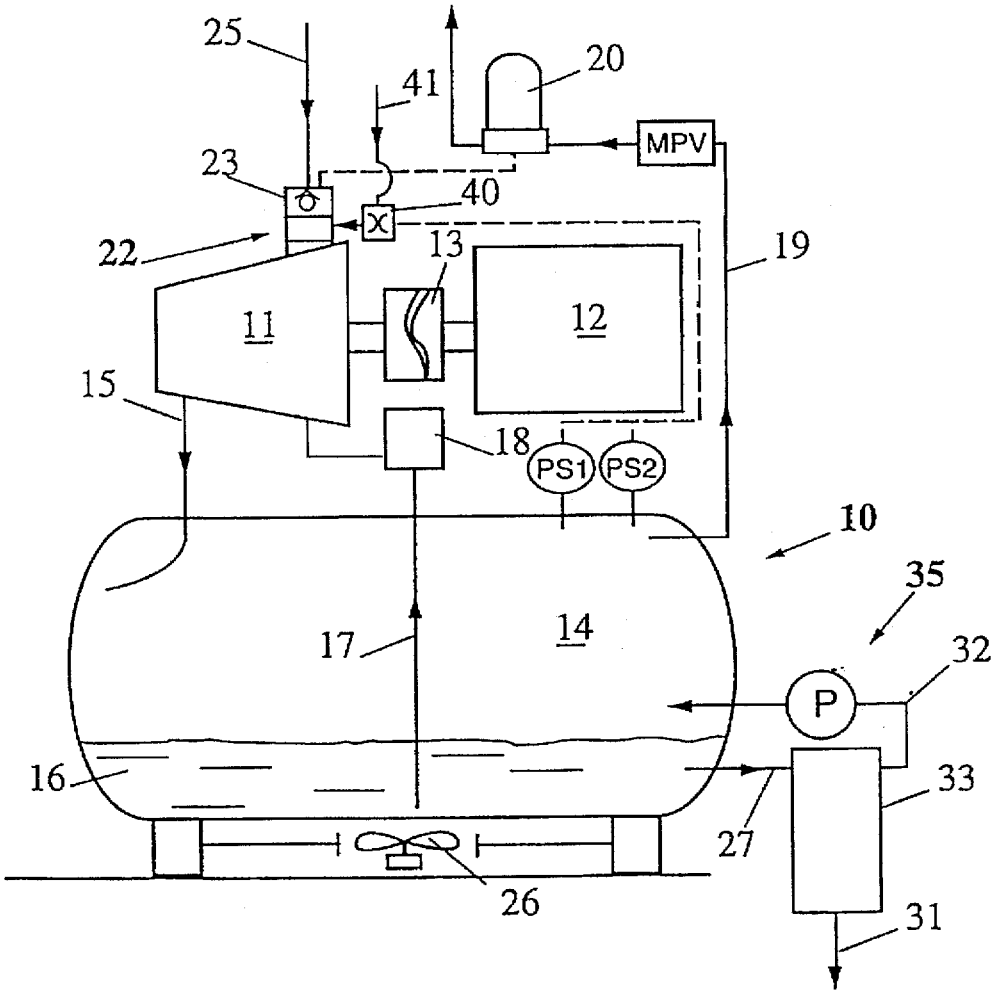

FIGS. 2*a* and 2*b* illustrate arrangements similar to FIG. 1 but where the dryer 24 in the air inlet flow is omitted and moisture is removed from the pressure vessel 14 by a moisture removal means 35. In the case of FIG. 2*a*, the means 35 comprises a line 27 removing oil from the pool 16, a regenerative heat exchanger 28, a hot oil sump 29, a heating device 30 and a pump P. The heating device 30 is provided so that the oil in the sump 29 is sufficiently hot to evaporate moisture 31 out of the oil. The pump P returns oil from the sump 29 via line 32 back into the pressure vessel 14. In doing so, it passes through the regenerative heat exchanger 28 to heat the oil leaving the pool 16 via line 27. In the embodiment of FIG. 2*b*, the means 35 comprises line 27, a coalescent type moisture/oil separator 33, and pump P. The separator 33 removes moisture from the oil and the oil is returned via line 32 and pump P to the pressure vessel 14. In both cases, the flow rate of oil and the capacity of the pump P need only be relatively small so that upon operation, moisture is continuously removed.

Figure 3:
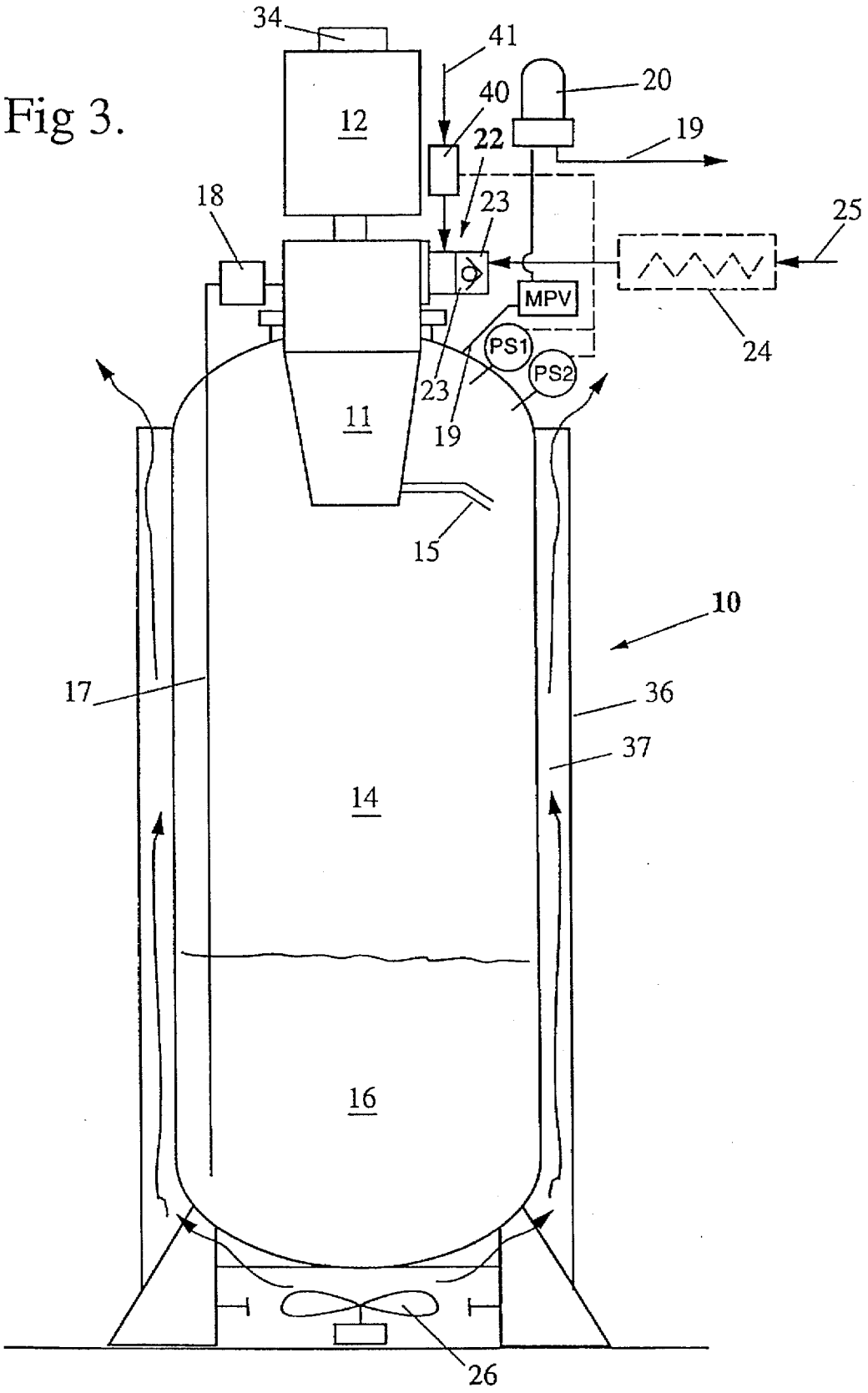
FIG. 3 is a schematic view of a still further preferred embodiment.

The embodiments shown in FIGS. 1, 2*a* and 2*b* are relatively wasteful of floor space and to this extent, it might be desirable to arrange the pressure vessel 14 in an upright or vertical configuration as shown in FIG. 3. In this embodiment, items of a similar nature have been given the same reference numerals as in the earlier described embodiments. In this proposed embodiment the screw compressor unit 11 is at least partially mounted within the pressure vessel 14 and the discharge pipe 15 therefrom discharges compressed gas and oil directly into the vessel 14. It should of course be appreciated that it would be possible to mount the compressor unit 11 through the upright wall of the vessel 14 with its axis horizontal or equally with the vessel 14 in a horizontal configuration, the compressor unit could be mounted horizontally extending through an end wall of the vessel 14 or vertically extending through a top horizontal wall section of the vessel 14. In the embodiment of FIG. 3, the motor 12 is directly coupled to the compressor unit 11 and a regulator 34 is provided to control the motor 12 on start up as indicated earlier in this specification. Such an arrangement could also be used in the embodiments of FIGS. 1, 2*a* and 2*b* if desired.

In this embodiment a dryer device 24 may be used (similar to FIG. 1) or alternatively, one of the moisture removal arrangements 35 disclosed with reference to FIGS. 2*a* and 2*b* might be used instead of the dryer 24. As the wall of the pressure vessel 14 can become quite hot during operation, it is desirable to shield same and this may be done by placing a concentric shield or wall 36 around same. The shield wall 36 also defines an annular passage 37 through which cooling air might pass to improve cooling effect.

In some compressor systems, it might be desired to use simply the heat of the pressure vessel 14 to prevent moisture condensing therein. In such systems, it would be necessary to ensure the system heats up quickly on start up and is maintained relatively hot when in operation. Thus, for example, it may be appropriate to provide a control system to prevent operation of the fan 26 on start up so that the system heats up quickly and runs for a predetermined period in a hot condition. Thereafter, the fan can be operated as needed to keep temperature of the vessel 14 within predetermined limits.

Figure 4:
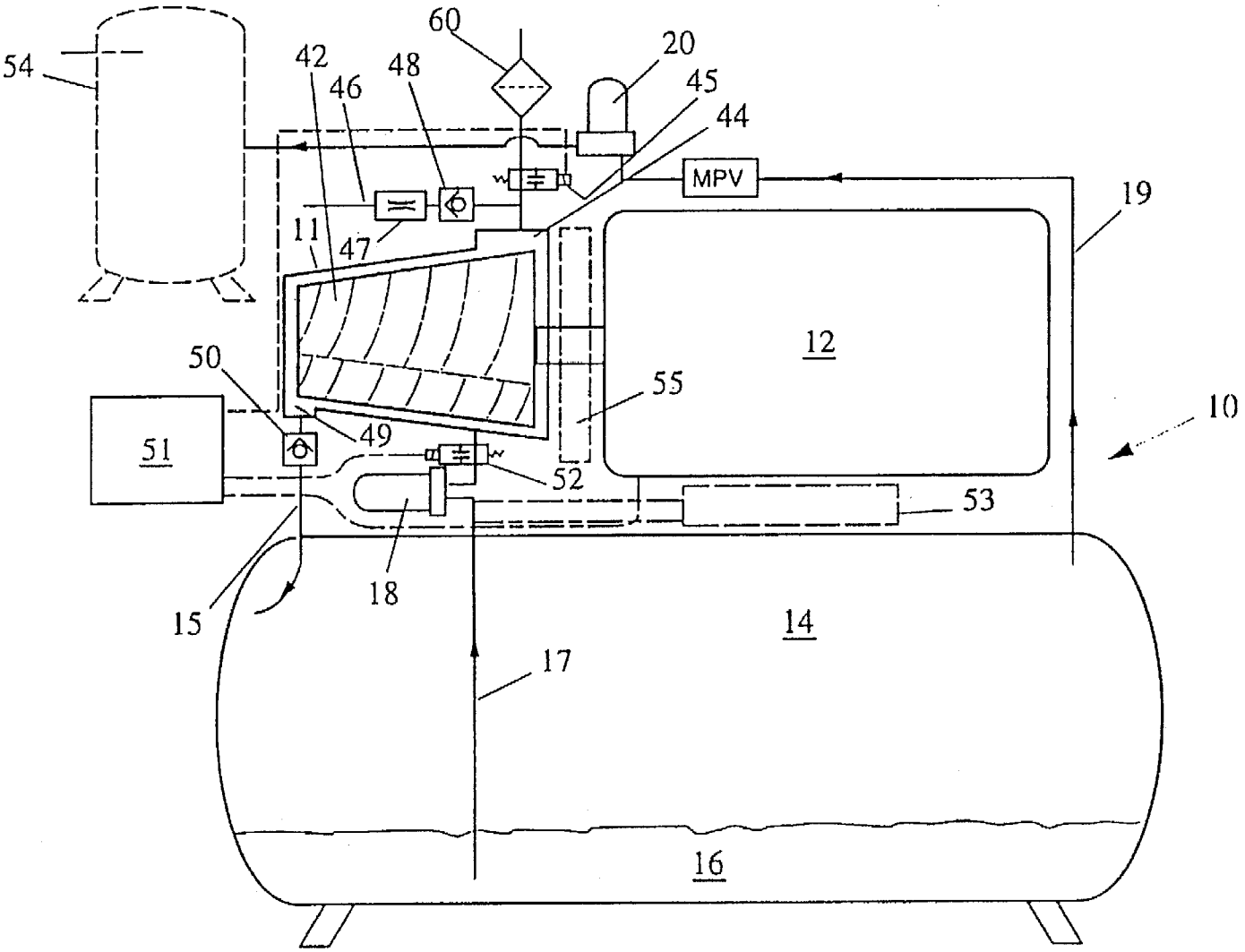
FIG. 4 is a schematic illustration of a still further preferred embodiment intended for use with smaller power motors.

Referring now to FIG. 4 of the drawings, the system 10 comprises a compressor unit 11 with intermeshing rotors 42 driven by a motor 12. The motor 12 is conveniently directly coupled to the compressor unit 11. Alternatively, a belt drive coupling may be useful in some circumstances as the pulleys of the belt drive may be used to add inertia into the rotating components as discussed in the following. The compressor unit 11 has an air intake region 44 with first valve means 45 interposed between the region 44 and an air intake filter 60. The first valve means 45 may be a two position solenoid valve which is normally closed but opened when air flow is desired. Any other form of valve capable of effecting a similar operation may also be utilised. Further, a line 46 with a restriction 47 also permits air to flow into the inlet region 44 via a non-return valve 48. The compressor unit 11 also has a discharge region 49 through which a compressed air and liquid mixture leaving the rotors 42 is discharged. Flow through the discharge region 49 is controlled by valve means 50 which is arranged as close as possible to the compressor unit 11 so as to limit the volume of the discharge region 49. The valve means 50 may be a non-return valve (swing check or ball type) or may be a solenoid operated or equivalent type valve. In the latter case, operation of the valve would be controlled by the control system 51. A pressure vessel 14 is provided to receive the mixture of compressed gas and liquid leaving the compressor unit 11 via line 15. The liquid/compressed gas mixture undergoes a primary separation in the vessel 14 so as to maintain liquid 16 in the base of the vessel 14.

A liquid return line 17 is provided leading from the pool of liquid 16 in the vessel 14 through a liquid oil filter 18 and second valve means 52 eventually being delivered to the rotors 42 within the compressor unit 11. Again the valve means 52 may be a two position normally closed solenoid valve but any other suitable valve means could be used. Liquid flow along line 17 depends upon a pressure differential existing between the vessel 14 and the introduction point to the compressor unit 11. If the arrangement is in accordance with FIGS. 1 to 3 then a cooling of the liquid returning to the compressor unit may not be necessary. A liquid cooler 53 may, however, also be employed as required. The compressed gas after having most of the liquid removed from it within the vessel 14 is then passed, via line 19 to a minimum pressure valve (mpv) and final filter element 20. After leaving the final filter element 20, the clean compressed gas might be delivered directly to an end user or to a gas storage tank 54 in a conventional system.

Finally, the control system 51 is provided controlling operation of the first valve means 45, the second valve means 52, and the motor 12. The control system, if required may also control operation of the valves 50 and 48. The arrangement is such as to ensure the valve means 45 and 52 are closed prior to the rotors 42 ceasing to rotate. The rotors 42 should complete at least one and preferably several revolutions after the valves 45 and 52 are closed. This may be achieved by stopping the motor 12 a predetermined period of time after the valve means are closed. Alternatively, the system may utilise inherent inertia to ensure the rotors 42 continue to operate for a period of time after the motor is stopped. If necessary, extra inertia such as a flywheel 55 might be utilised.

It is also possible, to vary the volume of the intake region 44 relative to the discharge region 49 so as to ensure the equilibrium pressure within the compressor unit (when stopped) does not exceed a predetermined level that would inhibit restarting of the system. Preferably this equilibrium pressure is about one atmosphere and preferably does not exceed 2.5 to 3.0 atmospheres.

Figure 5:
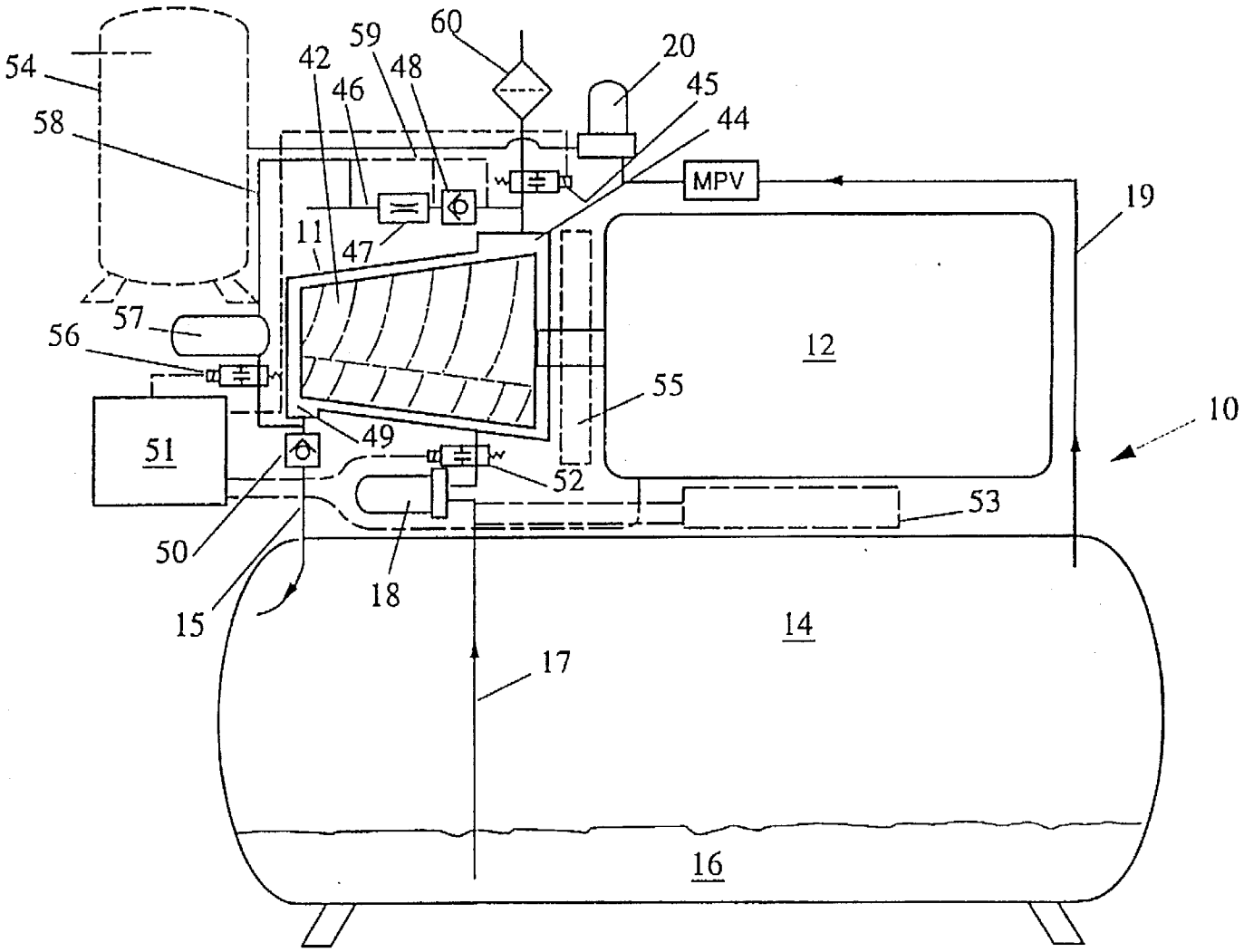
FIG. 5 is a schematic illustration similar to FIG. 4 modified for possible use with larger powered motors.

Reference will now be made to FIG. 5 of the annexed drawings. Like features to the integers described above with reference to FIG. 4 have been given the same reference numerals. FIG. 5 represents a system for use with larger powered motors and therefore capacity. Smaller horsepower motors may be started by direct on-line connection to a power supply, however, it is common practice for larger motors to be started using a star-delta starting means. In such systems the compressor unit 11 is started under "star" regime (low motor torque). The first valve means 45 is closed causing vacuum conditions in the compressor inlet region 44. To prevent pressure build up in the small discharge volume 49 (which would have the effect of increasing motor torque requirements), a two position (normally closed) solenoid valve 56 is opened (via a control signal from the control 51) and vents the discharge zone 49 to a vessel 57. The vessel 57 is connected via line 58 to the inlet region 44 of the compressor unit. Line 58 may connect with line 46 upstream of the restrictor 47 or downstream of the restrictor 47 or valve 48 as illustrated in dotted lines 59. The valve 48 is shown as a non-return valve, however, it could also be formed as a solenoid valve or other form of valve controlled by the control device 51. The vessel 57 may be quite small or if the volume of piping is sufficient, may be eliminated altogether. When the motor 12 switches to "delta" (high torque), the solenoid valve 56 closes and the inlet or first valve means 45 opens. It may be possible for the start sequence to occur without the oil stop valve (second valve means 52) opened in which case there would be no need for the vessel 57. If this is not possible, then the valve means 52 opens when the motor is operating in start regime and the vessel 57 also collects liquid. The vessel 57 drains liquid back to the compressor inlet over the first minutes of running. If desired, the vessel 57 may be integrally formed with the inlet region and inlet filter.

It will of course be appreciated that the annexed drawings are schematic and do not represent any particular configuration or assembly of the various components. Any known arrangement of component parts could equally be employed with the performance of the present invention.

I claim:

1. A compressor system comprising a rotary compressor unit with rotary compression means, a motor arranged to drive said compressor unit, a pressure vessel receiving pressurised gas and oil discharged from a discharge end of said compressor unit with oil being returned from said pressure vessel to an inlet region of said compressor unit, said compressor system being characterized by first valve means controlling gas flow into the compressor unit, second valve means controlling flow of oil to the inlet region of the compressor unit from said pressure vessel, third valve means controlling gas/oil discharge from said compressor unit to flow to said pressure vessel, and control means to control operation of at least said first and second valve means and said motor whereby, in use, said first and second valve means are closed prior to cessation of rotation of said rotary compression means.

2. A compressor system according to claim 1 wherein said rotary compression means completes at least one revolution after the first and second valve means are closed whereby a vacuum or a partial vacuum condition is established in the inlet region of the compressor unit.

3. A compressor system according to claim 1 or claim 2 wherein the system includes a discharge volume formed between a discharge point of the rotary compression means and the third valve means, and an intake gas volume formed downstream of the first valve means, the relative sizes of said discharge volume and said intake gas volume, being selected so as to ensure an equilibrium pressure is established within the compressor unit when the first and second valve means are closed, that is sufficiently low as to not inhibit restarting of the compressor unit.

4. A compressor system according to claim 3 wherein the equilibrium pressure is less than 3.0 atmospheres.

5. A compressor system according to claim 1 further including a secondary gas flow means to the inlet region of the compressor unit, the secondary gas flow means including a flow restrictor and fourth valve means and being arranged to direct gas flow into said inlet region downstream of said first valve means.

6. A compressor system according to claim 5 further including a minimum pressure valve whereby, upon start up, gas flow initially flows through said secondary gas flow means with said first valve means being maintained closed until pressure in said pressure vessel reaches a minimum pressure defined by said minimum pressure valve, whereupon said first valve means is opened.

7. A method of operating a compressor system of the type comprising a compressor unit with rotary compression means, a motor driving said rotary compression means, a pressure vessel receiving pressurised gas and oil from a discharge end of said compressor unit with oil being returned from said vessel to an inlet region of said compressor unit, said method being characterized by closing first valve means controlling gas flow into the compressor unit and second valve means controlling oil flow back to the compressor unit, by a predetermined time prior to cessation of rotation of said rotary compression means so as to create vacuum conditions in the inlet region of said compressor unit and to displace oil from said rotors upon stopping of the motor.

* * * * *

UNITED STATES PATENT AND TRADEMARK OFFICE

CERTIFICATE OF CORRECTION

PATENT NO. : 5,697,763

DATED : December 16, 1997

INVENTOR(S) : Anthony John Kitchener

It is certified that error appears in the above-identified patent and that said Letters Patent is hereby corrected as shown below:

Column 7, line 20, after "start" insert -- . --; "if" should be -- If --.

Signed and Sealed this

Fifth Day of May, 1998

Bruce Lehman

*Attest:*

BRUCE LEHMAN

*Attesting Officer*

*Commissioner of Patents and Trademarks*